US005979471A

United States Patent [19]

Wilby et al.

[11] Patent Number: 5,979,471

[45] Date of Patent: Nov. 9, 1999

[54] REMOVING LIQUIDS FROM TANKS

[75] Inventors: David K Wilby; Charles R B Lee; Mark A Knight, all of Warrington, United Kingdom

[73] Assignee: British Nuclear Fuels plc, Warrington, United Kingdom

[21] Appl. No.: 08/945,344

[22] PCT Filed: Apr. 4, 1996

[86] PCT No.: PCT/GB96/00836

§ 371 Date: Nov. 17, 1997

§ 102(e) Date: Nov. 17, 1997

[87] PCT Pub. No.: WO96/33820

PCT Pub. Date: Oct. 31, 1996

[30] Foreign Application Priority Data

Apr. 24, 1995 [GB] United Kingdom ..... 9508257

[51] Int. Cl.[6] ..... B08B 3/02; B08B 3/04; B08B 9/08; B08B 9/093

[52] U.S. Cl. ..... 134/22.18; 134/22.1; 134/24; 134/34; 134/166 R; 134/167 R; 134/168 R; 134/169 R; 134/172; 134/173; 134/174; 134/184; 134/186

[58] Field of Search ..... 134/22.1, 22.18, 134/24, 34, 166 R, 167 R, 168 R, 169 R, 172, 173, 174, 184, 186

[56] References Cited

U.S. PATENT DOCUMENTS

| | | | |
|---|---|---|---|
| 4,555,063 | 11/1985 | Goettsch | 241/46.04 |
| 5,078,799 | 1/1992 | Matter et al. | 134/22.18 |
| 5,409,025 | 4/1995 | Semler et al. | 134/111 |

FOREIGN PATENT DOCUMENTS

| | | |
|---|---|---|
| 159278 | 10/1985 | European Pat. Off. . |
| 0 502 218 A1 | 9/1992 | European Pat. Off. . |
| 2346693 | 4/1975 | Germany . |
| 1 495 089 | 12/1977 | United Kingdom . |
| 2 095 570 | 10/1982 | United Kingdom . |
| 8504122 | 9/1985 | WIPO . |
| 9318864 | 9/1993 | WIPO . |

OTHER PUBLICATIONS

Knight: "Sludge Retrieval, Treatment & Encapsulation," AG13.3–AG13.36 Dec. 1992.

Knight: "Basin Sludge Removal & Encapsulation Technology," Apr. 27, 1993, BNFL Inc., pp. 11–15.

BNFL Tank Retrieval Experience with Submerged Jet Technology, Oct. 1995, Los Alamos Technical Associates, Inc./BNFL, Inc., pp. 1–38.

*Primary Examiner*—Zeinab El-Arini

*Attorney, Agent, or Firm*—Nixon & Vanderhye P.C.

[57] ABSTRACT

Apparatus for removing a liquid (2) containing suspendible solid matter from a tank (1) comprises a plurality of nozzles (47) located at the lower region of the tank. A pump (10) removes the liquid and ejects it through the nozzles (47) to cause resuspension of settled solid matter. When sufficient resuspension has occurred, the tank (1) is emptied by opening a valve to remove a portion of the liquid being transferred to the nozzles (47). The nozzles (47) are arranged as oppositely facing pairs ofjet nozzles at the lower end of a rotatable vertical pipe (46). The pump (10) is suspended by a cable (13) connected to a drum (19) which can be rotated to raise or lower the pump. A pump outlet (12) is connected to a flexible hose (27) which is wound around the drum (19) or around a separate drum (110). A movable containment flask (14) houses the drum (19) and accommodates the pump (10) when withdrawn from the tank (1).

23 Claims, 6 Drawing Sheets

REMOVING LIQUIDS FROM TANKS

This is a national stage application of PCT/GB96/00836 filed Apr. 4, 1996.

BACKGROUND OF THE INVENTION

1. Field of the Invention

The present invention relates to apparatus and a method for removing liquids from tanks or similar vessels.

2. Discussion of Prior Art

In certain industrial processes, liquid waste containing suspended solids may be discharged to a tank in which it is stored to await further treatment or disposal. After the liquid waste has been stored for a period of time, the suspended solids tend to settle and form a sludge at the bottom of the tank. When the liquid has to be removed from the tank the presence of the sludge makes it difficult to remove the entire contents of the tank.

SUMMARY OF THE INVENTION

According to a first aspect of the invention there is provided apparatus for removing a liquid containing suspendible solid matter from a tank, the apparatus comprising at least one nozzle means located at a lower region of said tank where said solid matter tends to settle, a pump having an inlet submersed in said liquid and having an outlet communicating with said nozzle means, the pump being operable to withdraw said liquid into the inlet and transfer the liquid through the outlet to the nozzle means so as to agitate the suspendible solid matter, and liquid removal means located between said outlet and said nozzle means to remove a portion of said liquid being transferred to said nozzle means whereby the liquid is discharged from the tank.

Preferably drive means are operatively connected to said nozzle means whereby to effect rotation thereof.

The nozzle means may be located at the lower end of a vertically arranged pipe the upper end of which is operatively connected to said drive means.

Each nozzle means may comprise a pair of jet nozzles one of which faces in substantially the opposite direction to that of the other.

Preferably the apparatus comprises a plurality of nozzle means.

In a preferred embodiment the apparatus comprises three nozzle means.

Preferably each of said nozzle means has an associated valve means for controlling the supply of liquid to the nozzle means.

The pump may be suspended by cable means which is connected to a rotatable drum, and drive means operatively connected to said drum so as to effect rotation thereof, whereby rotation of said drum in one direction causes winding of the cable means around the drum so as to raise the pump and rotation of the drum in the other direction causes unwinding of the cable means from the drum so as to lower the pump.

Preferably the pump outlet communicates with a flexible hose which is wound around the drum, the drum being arranged for rotation on a hollow axle which communicates with the flexible hose and said nozzle means.

The drum may be rotatably mounted in a flask located above the tank, whereby rotation of the drum in said one direction can be effected to raise the pump into the flask.

The flexible hose may be wound around a further rotatable drum, the further drum being rotatable on a hollow axle which communicates with the flexible hose and said nozzle means.

Advantageously conveying means are provided for moving the flask away from the tank away from the tank.

The conveying means may comprise a pair of rails along which the flask is adapted to run.

Alternatively, the conveying means may comprise a plurality of air bearings provided on the flask, whereby the flask can be moved on a cushion of air derived from pressurised air supplied to said air bearings.

A radiation containment housing is preferably provided in the flask for accommodating the pump.

According to a second aspect of the invention there is provided a method of removing a liquid containing suspendible solid matter from a tank equipped with liquid removal apparatus, the liquid removal apparatus comprising at least one nozzle means located at a lower region of said tank where said solid matter tends to settle, and a pump having an inlet submersed in said liquid and having an outlet communicating with said nozzle means, the method comprising the steps of agitating the suspendible solid matter by operating said pump so as to withdraw the liquid through the inlet and transfer the liquid through the outlet to the nozzle means, and discharging the liquid from the tank by removing a portion of the liquid being transferred from the pump to the nozzle means.

Preferably the step of agitating the suspendible solid matter includes rotating the said nozzle means.

In a preferred embodiment, the liquid removal apparatus comprises a plurality of nozzle means, wherein the step of agitating the said suspendible matter includes connecting the pump to each nozzle means in turn.

The step of discharging the liquid from the tank may include connecting the pump to all of said nozzle means simultaneously while removing a portion of said liquid being transferred to all of said nozzle means.

The method may include the step of positioning the pump in the upper region of said liquid and then lowering the pump while discharging the liquid from the tank.

BRIEF DESCRIPTION OF THE DRAWINGS

The invention will now be described, by way of example only, with reference to the accompanying drawings, in which.

DETAILED DISCUSSION OF PREFERRED EMBODIMENTS

Figure 1:
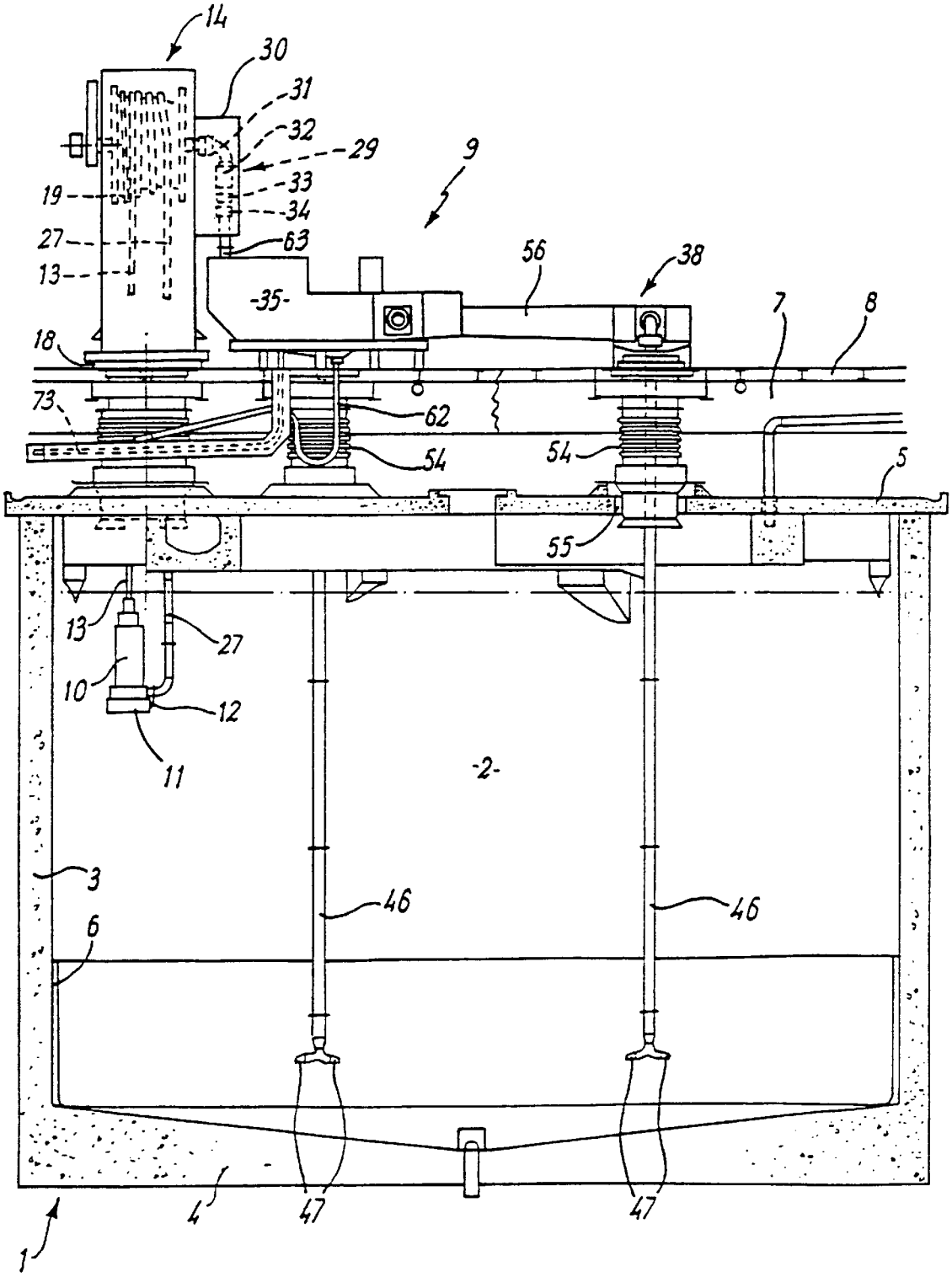
FIG. 1 is a cross-sectional elevation on the line I—I in FIG. 2 of a tank equipped with a liquid resuspension and removal apparatus according to a preferred embodiment of the invention.
Figure 2:
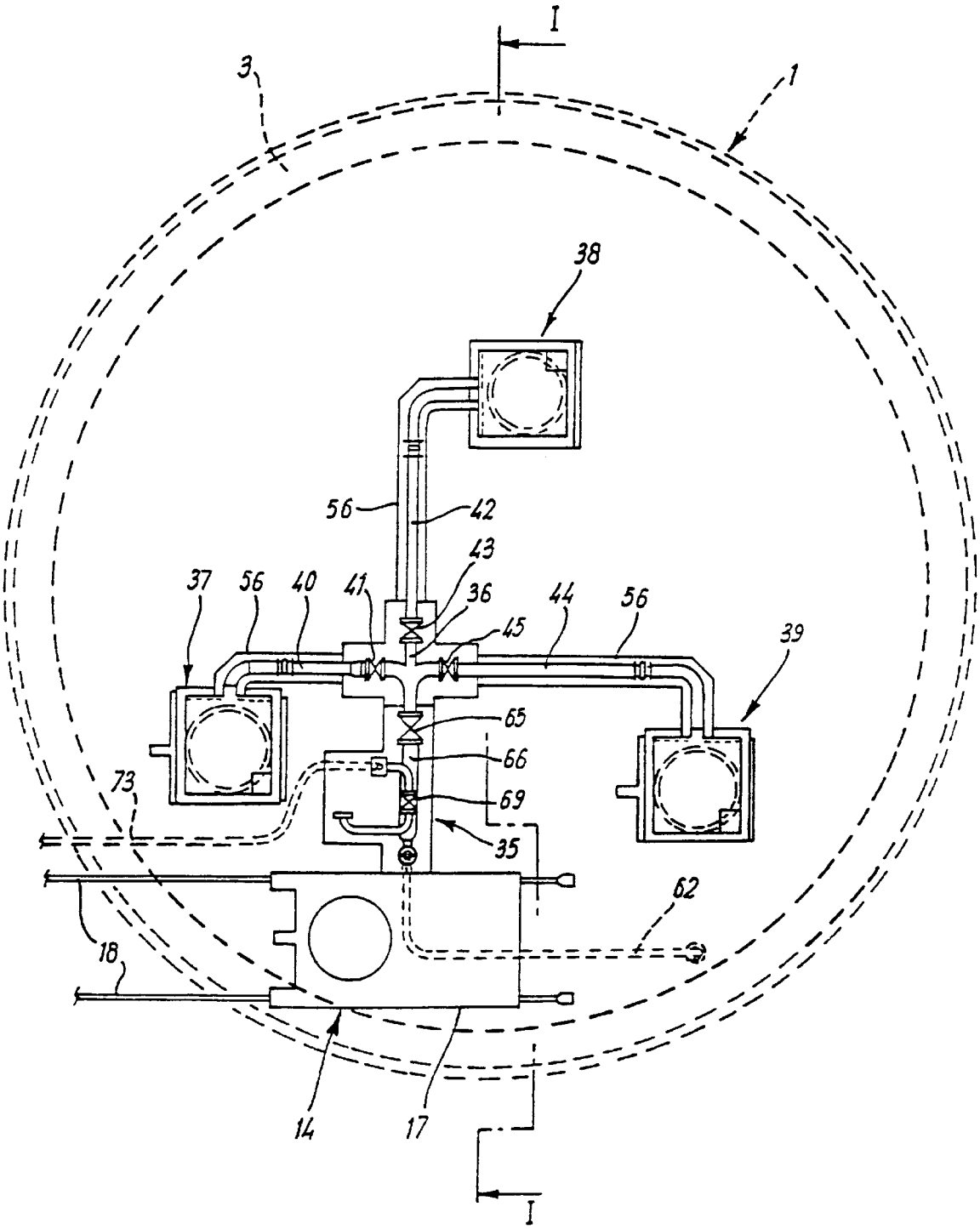
FIG. 2 is a plan view of the tank and liquid removal apparatus shown in FIG. 1.

Referring to FIGS. 1 and 2, a tank 1 contains a liquid 2 in which suspendible solids have settled over a period of time to form a sludge at the lower region of the tank 1. The liquid 2 may, for example, comprise a radioactive alumino-ferric floc arising from an actinide reduction process used in the reprocessing of spent nuclear fuel. The tank 1 is constructed from a concrete material and comprises a cylindrical wall 3, a base 4 and a cover 5. A stainless steel anti-scouring band 6 may be secured to the inner surface of the wall 3 at the lower region thereof. Above the tank 1 are a number of beams 7 for supporting a floor 8 on which a liquid resuspension and removal apparatus 9 is mounted. The apparatus 9 includes a submersible pump 10 having an inlet 11 and an outlet 12. The pump 10 is suspended on a cable 13 which extends upwardly through the cover 5 into a containment flask 14, which is supported by the floor 8.

Figure 3:
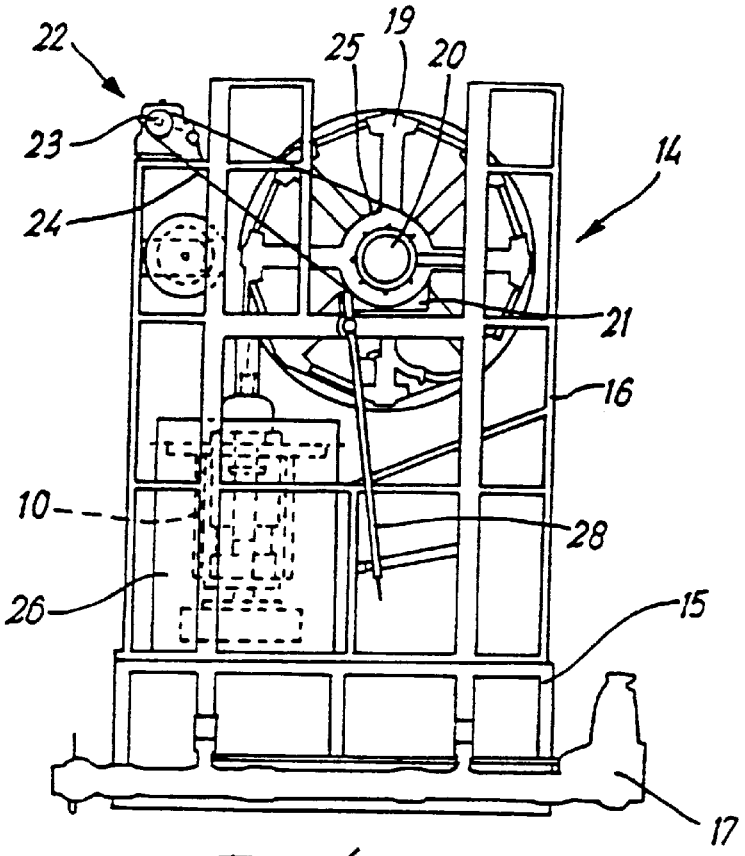
FIGS. 3 and 4 show, respectively, an elevation and plan view of a pump containment flask.
Figure 4:
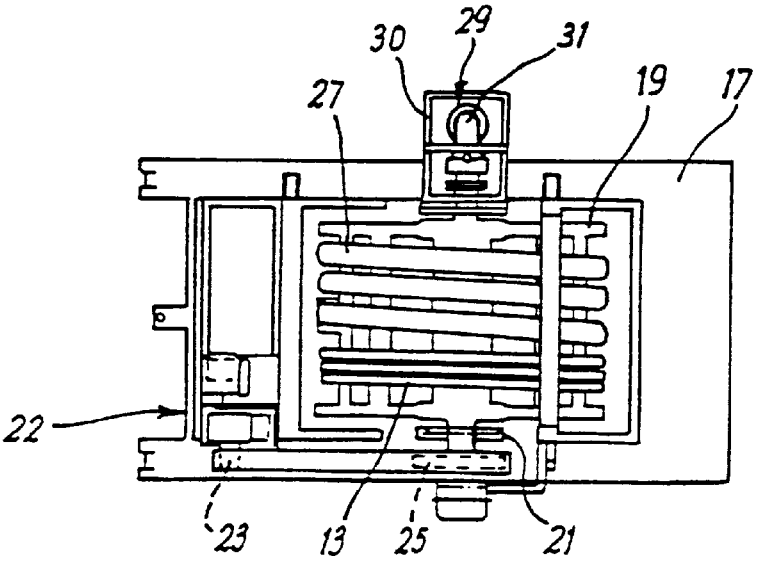

As best seen in FIGS. 3 and 4, the flask 14 is a fabricated structure comprising a base frame 15 and an upper frame 16. The base frame 15 is mounted on a wheeled transit bogie 17 which is arranged to run on a pair of rails 18 extending along the floor 8 (see FIG. 2). The pump suspension cable 13 is attached to and wound around a reeling drum 19 which is rotatably supported by a hollow axle 20 arranged to run in a pair of bearings 21. Rotation of the drum 19 is derived from a motor and gearbox drive assembly 22 mounted on the upper frame 16. A chain pinion 23 mounted on an output shaft of the drive assembly 22 is connected by a chain 24 to a chain wheel 25 supported on the shaft 20. By operation of the drive assembly 22, the drum 19 can be rotated so as to raise and lower the cable 13. By rotating the drum 19 so as to wind the cable 13 thereon, the pump 10 can be raised through an opening (not shown) in the cover 5 of the tank 1 into a containment housing in the form of a radiation shielding shroud 26 incorporated in the flask 14.

Connected to the pump outlet 12 is a flexible hose 27 which extends upwardly through the cover 5 into the flask 14. The hose 27 is wound around the periphery of the drum 19 adjacent to the cable 13. Thus, on rotation of the drum 19 in the appropriate direction, the hose 27 and the cable 13 can be raised or lowered simultaneously. For maintenance purposes, the drum 19 can be braked by movement of a brake lever 28. In an alternative arrangement, separate reeling drums, each with its own driving arrangement, can be provided for the hose 27 and the cable 13 (see FIG. 9). The hose 27 communicates by means of a slip ring assembly (not shown) with the interior of the hollow shaft 20 which, in turn, communicates with an outlet pipe assembly 29 supported in an outlet frame 30. Included in the outlet pipe assembly 29 is a swivel coupling 31 which rotatably accommodates an end of the hollow shaft 20. The swivel coupling 31 is in the form of a 90° elbow which connects the rotatable horizontal shaft 20 to a stationary vertical section of the outlet pipe assembly 29. Incorporated in this vertical section are a flexible connection 32, a plug valve 33 and an expansion coupling 34.

The outlet pipe assembly 29 communicates through a feed and discharge valve assembly 35 and a distribution pipe 36 with three resuspension units 37, 38, 39. The resuspension unit 37 is served by an encased pipe 40 and a valve 41, the resuspension unit 38 is served by an encased pipe 42 and a valve 43 and the resuspension unit 39 is served by an encased pipe 44 and a valve 45. Each resuspension unit comprises a vertical elongate downpipe 46 terminating at its lower end in two horizontal nozzles 47 disposed so as to face in opposite directions.

Figure 5:
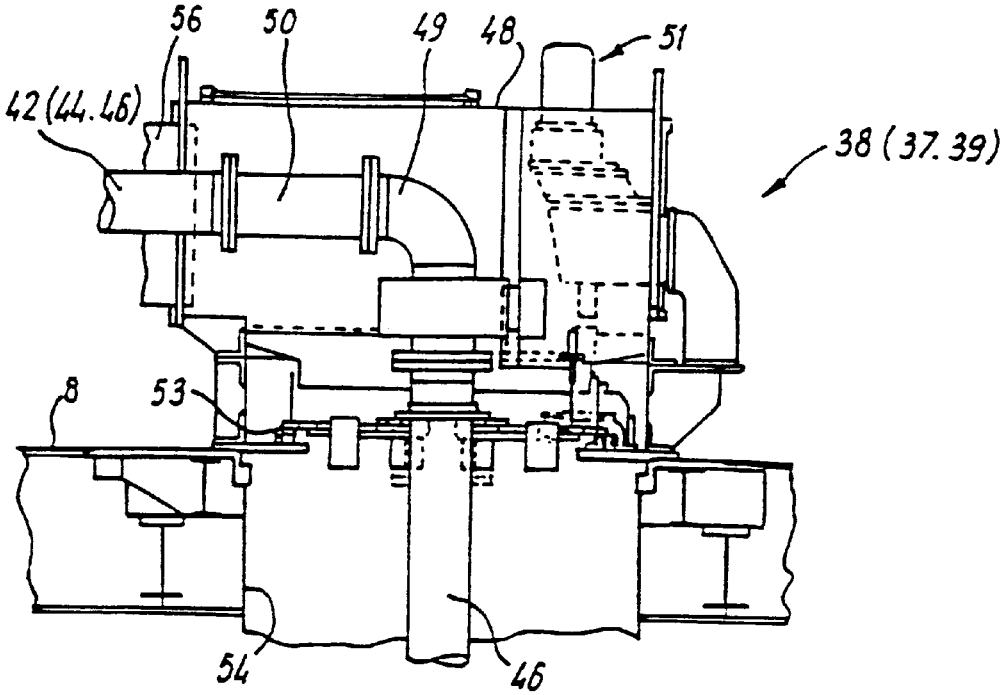
FIG. 5 is a cross-sectional elevation on the line V—V in FIG. 6 of a drive system for a resuspension nozzle.
Figure 6:
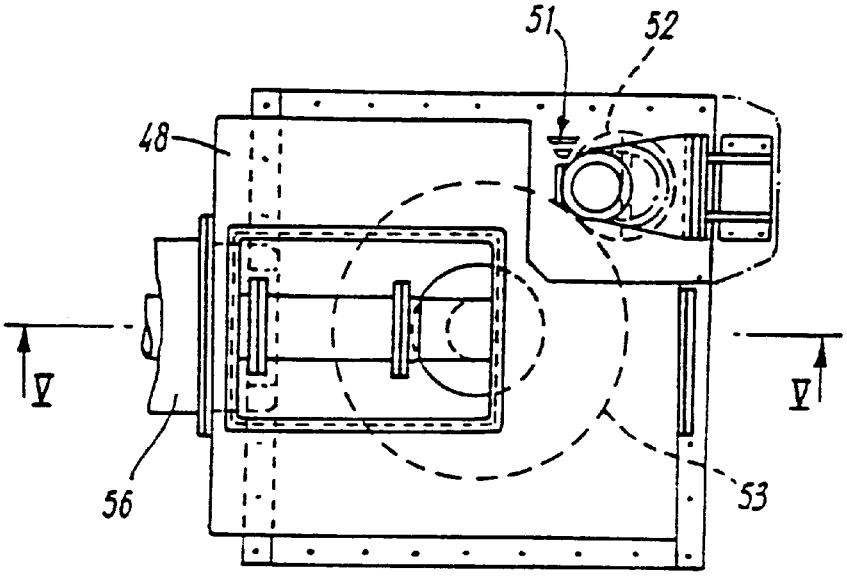
FIG. 6 is a plan view of the drive system shown in FIG. 5.

Reference is now made to FIGS. 5 and 6, which show a nozzle drive assembly typical for each of the resuspension units 37, 38, 39. The nozzle drive assembly comprises a housing 48 which is supported on the floor 8 and accommodates the upper end of the downpipe 46. An upper end of the downpipe 46 is rotatably received in a swivel coupling 49 which forms a 90° angle and is connected to the pipe 42 by means of a flexible coupling 50. Rotation of the downpipe 46 is derived from a motor and gearbox drive assembly 51 located outside the housing 48. A pinion 52, mounted on an output shaft of the drive assembly 51, meshes with a gearwheel 53 connected to the downpipe 46. A protective skirt 54 extends downwardly from the casing 48 and projects into the tank 1 through an opening 55 in the cover 5. Each of the pipes 40, 42, 44 is enclosed in a casing 56, the top cover of which has been removed in FIG. 2 for clarity.

Figure 7:
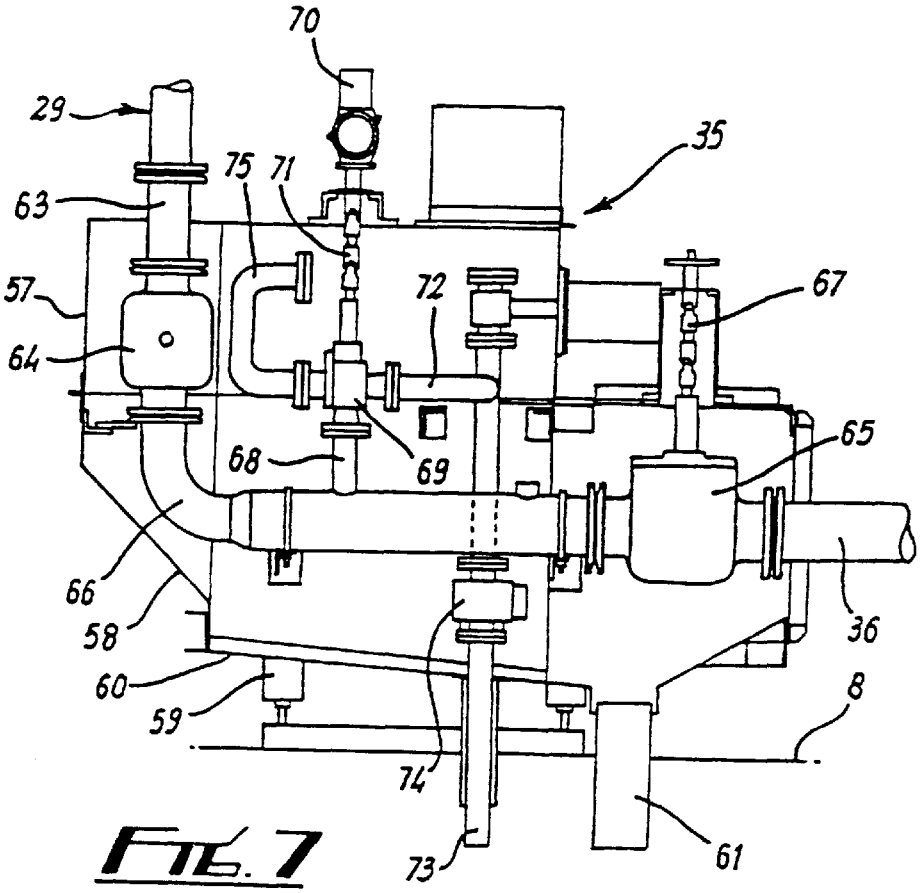
FIGS. 7 and 8 show, respectively, a sectional elevation and a plan view of a feed and discharge valve assembly.
Figure 8:
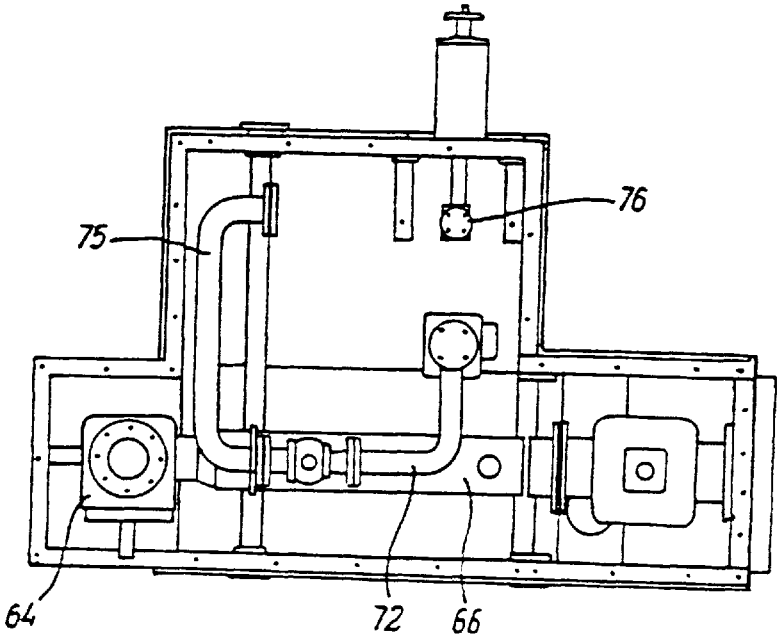

As seen in FIGS. 7 and 8, the feed and discharge valve assembly 35 comprises an upper housing 57 and a lower housing 58 which are supported on the floor 8 by a support structure 59. The lower housing 58 has a base 60 formed by declivitous surfaces sloping downwardly towards a drain pipe 61 through which any liquid accumulating in the lower housing can be directed to a drain line 62 which transfers the drained liquid into the tank (see FIG. 2). The outlet pipe assembly 29 from the housing 14 is connected through a short connecting pipe 63 to a valve 64 operated by a valve actuator (not shown). The outlet side of the valve 64 communicates with a further valve 65 through a feed pipe 66 which has an initial portion formed into a 90° angle so as to change the pipe line flow from a vertical direction to a horizontal direction. Operation of the valve 65 is achieved by means of an actuator (not shown) connected to the valve by a valve coupling 67. Connected to the outlet side of the valve 65 is the distribution pipe 36 leading to the valves 41, 43, 45 which serve, respectively, the resuspension units 37, 38, 39.

A discharge branch 68 extends upwardly from the feed pipe and leads to a 3-way discharge valve 69. Operation of the valve 69 is effected by an actuator 70 connected to the valve by a valve coupling 71. The valve 69 has a first outlet connected through a pipe section 72 to a discharge line 73 which includes a further valve 74. A second outlet from the 3-way valve 69 is connected to a hydrocyclone feed pipe 75 which may be connected, if required, to a hydrocyclone unit (not shown). A liquid outlet from the hydrocyclone unit communicates with the discharge line 73 and an outlet for separated solid matter can be discharged through a valve 76 to a solids discharge pipe (not shown).

To effect a complete removal of the liquid 2 from the tank 1, the solid matter, which may have formed into a sludge at the lower region of the tank, must be resuspended in the supernate liquid. The removal procedure involves lowering the pump 10 from the flask 14, by rotation of the reeling drum 19 in the appropriate direction, to a position in which the pump is immersed in the upper region of the supernate phase of the liquid 2, as seen in FIG. 1. The plug valve 33 and the valves 64, 65 and 41 are set to their open positions. The 3-way discharge valve 69 and the valves 74, 43 and 45 are set in their closed positions. Operation of the drive assembly 51 associated with the resuspension unit 37 is commenced so as to cause rotation of the downpipe 46. The gearbox associated with the drive assembly 51 is adjusted so that rotation of the downpipe 46 is very slow and is preferably in the order of 0.2 rpm. Operation of the pump 10 is started so that liquid 2 is withdrawn through the pump inlet 11 and discharged through the outlet 12. The liquid passes through the hose 27 and then through the hollow shaft 20 to be discharged from the housing 14 through the outlet pipe assembly 29. After passing through the valve 64, the feed pipe 66 and the valve 65, the liquid is transferred to the opposed nozzles 47, associated with the resuspension unit 37, via the distribution pipe 36, the pipe 40 and the downpipe 46. As a result of the liquid flow ejected through the rotating nozzles 47 a circle of resuspension is produced. This has the effect of causing resuspension of the settled solid matter in approximately one-third of the tank in the vicinity of the nozzles 47. After a period of time, operation of the resuspension unit 37 is stopped and the valve 41 is closed. This procedure is then repeated by operation of the resuspension unit 38 for a further period of time. For the operation of the resuspension unit 38, the valves 41 and 45 are closed and valve 43 is open. After this further period of time, operation of the resuspension unit 38 is stopped and, with the valves 41 and 43 closed and the valve 45 open, the resuspension unit 39 is brought into use. By operating each resuspension unit independently, the maximum pressure exerted by the pump 10 can be applied to the nozzles 47 so that efficient resuspension of the solid matter is achieved.

Each resuspension unit may then be operated in turn for reducing periods of time. For example, each resuspension unit may be operated for a two-hour period, then a one-hour period and finally a half-hour period. The resuspension phase of the tank emptying operation may continue for a period of two or three weeks depending on the nature of the liquid/settled sludge to be removed.

When sufficient resuspension of the solid matter has been achieved, the supernate liquid 2 can then be removed. For liquid removal, all of the resuspension units 37, 38, 39 are operated simultaneously which entails opening all three of the distribution valves 41, 43, 45. In addition, the actuator 70 is operated so that the 3-way discharge valve 69 allows a portion of the liquid from the pump 10 to pass into the pipe section 72. This liquid is then transferred through the valve 74 for discharge to a remote location through the discharge line 73. If desired, the 3-way discharge valve 69 may be set so that the liquid discharged from the tank 1 is directed through the feed pipe 75 to the hydrocyclone unit so as to remove solid matter from the discharged liquid.

Thus, during emptying of the tank 1 agitation of the liquid is continued by the action of liquid being expelled through each of the three pairs of opposed nozzles 47. Although the pressure produced by the pump 10 is distributed between the three pairs of nozzles 47, this is sufficient to prevent resettlement of the suspended solids.

During emptying of the tank 1, the drive assembly 22 is operated so that the chain 24 causes a slow rotation of the reeling drum 19 in an anti-clockwise direction, when as viewed in FIG. 3. This results in the unwinding of the hose 27 and the cable 13 from the drum so that the pump 10 is lowered down the tank 1. The rate at which the pump 10 is lowered is such that at least the pump inlet 11 is maintained at a position below the gradually falling liquid level.

When the tank is empty, the drive assembly 22 is operated so as to rotate the reeling drum 19 in the opposite direction, ie clockwise when as viewed in FIG. 3. Thus, the reeling drum 19 winds up the hose 27 and the cable 13 so that the pump 10 is withdrawn into the shielding shroud 26 of the flask 14. After disconnecting the outlet pipe assembly 29 from the feed and discharge valve assembly 35, the flask 14 can be transported by the bogie 17 along the rails 18 away from the tank 1. Since the pump 10 is radioactively contaminated by its contact with the liquid 2, the shroud 27 serves to prevent the transmission of hazardous radiation into the surrounding environment. If desired, the flask 14 can be moved to another similar tank which requires emptying.

Figure 9:
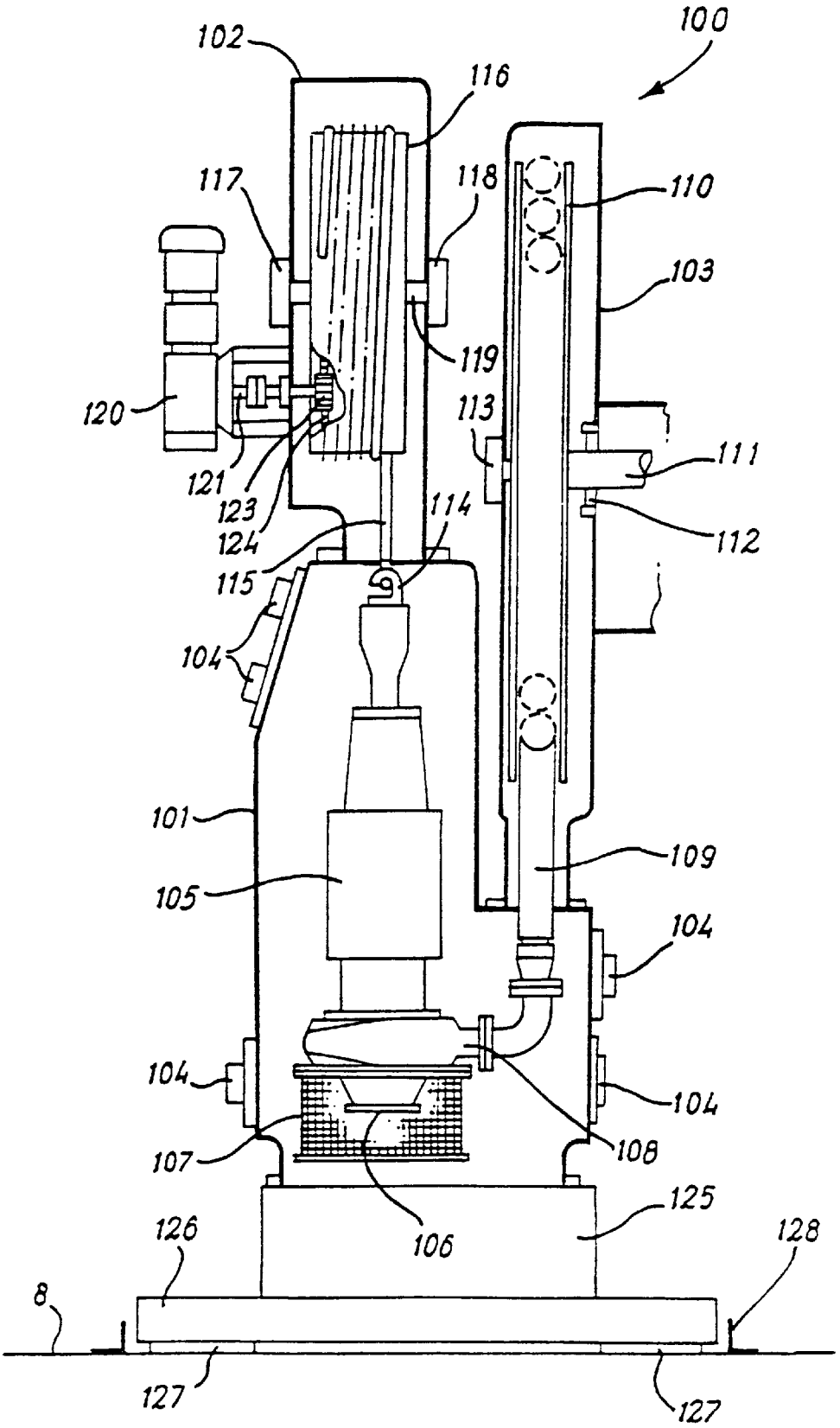
FIG. 9 is a cross-sectional elevation of a pump containment flask in an alternative form.

An alternative form of pump containment flask is shown in FIG. 9, to which reference is now made. The containment flask 100 comprises a pump housing 101, a cable reeling drum housing 102 and a hose reeling drum housing 103. Each of the housings 101, 102, 103 is fabricated from stainless steel to form a radiation containment enclosure. Access to the inside of the pump housing 101 can be obtained by means of several glove ports 104.

The pump housing 101 is designed to accommodate a submersible pump 105 when the latter is withdrawn from the tank 1. The pump 105 is provided with an inlet 106 which is surrounded by a wire mesh strainer 107. An outlet 108 from the pump is connected to a flexible hose 109 which is wound around a monospiral hose reeling drum 110 arranged in the housing 103. The hose reeling drum 110 is supported on a hollow shaft 111 arranged for rotation in a pair of bearings 112, 113.

A motor and gearbox drive unit (not shown) is provided for effecting rotation of the shaft 111 and the hose reeling drum 110. The hose 109 communicates with the interior of the hollow shaft 111 which, in turn, communicates through a swivel joint and isolation valve (not shown) with the feed and discharge valve assembly 35.

A suspension hook 114 is provided at the upper end of the pump 105 for engagement with a cable 115. The cable 115 extends upwardly into the cable reeling drum housing 102 and is wound in a spiral around a cable reeling drum 116. A pair of bearings 117, 118 is provided on the housing 102 for rotatably supporting a shaft 119 on which the drum 116 is fixedly mounted. Rotation of the drum 116 is effected by a motor and gearbox drive unit 120. An output shaft 121 from the drive unit 120 is coupled to a drive pinion 123 which is in meshing engagement with gear teeth 124 provided around the interior of the drum 116.

The pump housing 101 is mounted on a plinth 125 which houses a stainless steel containment gate (not shown). In use, the containment gate is operated to open a normally closed aperture through which the pump 105 enters and leaves the housing 101. Beneath the plinth 125 is a flask transporter 126 provided on its under surface with several air bearings 127. Pressurised air can be supplied to the bearings 127 so as to lift the containment flask 100 on a cushion of air formed beneath the bearings 127. When elevated on the cushion of air, the containment flask can be moved between a pair of guides 128 extending along the floor 8.

Resuspension of the solid matter and then removal of the liquid 2 from the tank 1 is effected in a manner similar to that hereinbefore described. Thus, after opening the containment gate in the plinth 125, the pump 105 is lowered from the housing 101 into the upper region of the supernate phase of the liquid 2 by rotation of the hose reeling drum 110 and the cable reeling drum 116 in the appropriate directions. The pump 105 is then operated to withdraw liquid 2 from the tank 1 and to transfer the liquid so that it is ejected through each of the nozzle means 47 in turn and then all of them simultaneously, as previously described. When sufficient resuspension of the solid matter has been achieved, the liquid 2 is removed by opening the discharge valve 69. This allows a portion of the liquid passing from the pump 105 to the nozzle means 47 to pass into the pipe section 72 for discharge through the line 73.

During emptying of the tank 1, the drive unit 120 for the cable reeling drum 116 and the drive unit (not shown) for the hose reeling drum 110 are operated so as to unwind the cable 115 and the hose 109 from their associated drums. Thus, the pump 105 is lowered slowly to maintain submersion of the pump inlet 106 below the falling liquid level. When the tank 1 is empty, the cable and hose reeling drums 116, 110, respectively, are rotated so as to withdraw the pump 105 into the containment housing 107.

The containment gate (not shown) within the plinth 125 is then closed so as to seal the pump housing 101 and the pipe connections between the valve assembly 35 and the containment flask 100 are disconnected. The flask 100 can then be moved away from the tank 1 between the guides 128 on a cushion of air formed beneath the air bearings 127.

We claim:

1. Apparatus for removing a liquid containing suspendible solid matter from a tank, comprising;

at least one nozzle located at a lower region of said tank where said solid matter tends to settle;

a pump having an inlet submersed in said liquid and having an outlet communicating with said nozzle, the pump being operable to withdraw said liquid into the inlet and transfer the liquid through the outlet to the nozzle so as to agitate the suspendible solid matter; and liquid removal structure located between said outlet and said nozzle to remove a portion of said liquid being transferred to said nozzle whereby the liquid is discharged from the tank.

2. Apparatus according to claim 1, wherein the liquid removal structure comprises a discharge valve which is operable to allow a portion of liquid being transferred to the nozzle to pass to a discharge pipe.

3. Apparatus according to claim 1, wherein a drive assembly is operatively connected to the nozzle whereby to effect rotation thereof.

4. Apparatus according to claim 3, wherein the nozzle is located at the lower end of a vertically arranged pipe, the upper end of which is operatively connected to said drive assembly.

5. Apparatus according to claim 4, wherein the nozzle comprises a pair ofjet nozzles, one of which faces in substantially the opposite direction to that of the other.

6. Apparatus according to claim 1, wherein a plurality of nozzles are provided.

7. Apparatus according to claim 1, wherein three nozzles are provided.

8. Apparatus according to claim 1, wherein said nozzle has an associated valve whereby to control supply of liquid to the nozzle.

9. Apparatus according to claim 1, wherein the pump is suspended by a cable which is connected to a rotatable drum, and drive assembly operatively connected to said drum so as to effect rotation thereof, whereby rotation of said drum in one direction causes winding of the cable around the drum so as to raise the pump and rotation of the drum in the other direction causes unwinding of the cable from the drum so as to lower the pump.

10. Apparatus according to claim 9, wherein the pump outlet communicates with a flexible hose which is wound around the drum, the drum being rotatable on a hollow axle which communicates with the flexible hose and with said nozzle.

11. Apparatus according to claim 9, wherein the drum is rotatable mounted in a flask located above the tank, whereby rotation of the drum in said one direction can be effected to raise the pump into the flask.

12. Apparatus according to claim 11, wherein a transporter is provided for moving the flask away from the tank.

13. Apparatus according to claim 12, wherein the transporter comprises a pair of rails along which the flask is adapted to run.

14. Apparatus according to claim 13, wherein the transporter comprises a plurality of air bearings provided on the flask, whereby the flask can be moved on a cushion of air derived from pressurized air supplied to said air bearings.

15. Apparatus according to claim 11 wherein a radiation shielding shroud is provided in the flask for accommodating the pump.

16. Apparatus according to claim 9, wherein a further rotatable drum is provided around which a flexible hose communicating with the pump outlet is wound, the further drum being rotatable on a hollow axle which communicates with the flexible hose and said nozzle.

17. A method of removing a liquid containing suspendible solid matter from a tank equipped with liquid removal apparatus, the liquid removal apparatus comprising at least one nozzle located at a lower region of said tank where said solid matter tends to settle, and a pump having an inlet submersed in said liquid and having an outlet communicating with said nozzle, the method comprising the steps of:

agitating the suspendible solid matter by operating said pump so as to withdraw the liquid through the inlet and transfer the liquid through the outlet to the nozzle; and discharging the liquid from the tank by removing a portion of the liquid being transferred from the pump to the nozzle.

18. A method according to claim 17, wherein the step of agitating the suspendible solid matter includes rotating said nozzle.

19. A method according to claim 17, wherein the liquid removal apparatus comprises a plurality of nozzles, wherein the step of agitating said suspendible matter includes connecting the pump to each nozzle in turn.

20. A method according to claim 19, wherein the step of discharging the liquid from the tank includes connecting the pump to all of said nozzles simultaneously while removing a portion of said liquid being transferred to all of said nozzles.

21. A method according to claim 17, and further including the step of positioning the pump in an upper region of the liquid and then lowering the pump while discharging the liquid from the tank.

22. Apparatus for removing a liquid containing suspendible solid matter from a tank, wherein at least one of said liquid and solid matter is a radioactive material, said apparatus comprising:

at least one nozzle located at a lower region of said tank where said solid matter tends to settle, a single pump having an inlet submersed in said liquid and having an outlet communicating with said at least one nozzle, the pump being operable to withdraw said liquid into the inlet and transfer the liquid through the outlet to said at least one nozzle so as to agitate the suspendible solid matter, and liquid removal valve located between said outlet and said at least one nozzle to remove a portion of said liquid being transferred to said at least one nozzle whereby the liquid is discharged from the tank without the need for contaminating an additional pump with said radioactive material.

23. A method of removing a liquid containing suspendible solid matter from a tank equipped with liquid removal apparatus, wherein at least one of said liquid and solid matter is a radioactive material, the liquid removal apparatus comprising at least one nozzle located at a lower region of said tank where said solid matter tends to settle, and a pump having an inlet submersed in said liquid and having an outlet communicating with said at least one nozzle, the method comprising the steps of:

agitating the suspendible solid matter by operating said pump so as to withdraw the liquid through the inlet and transfer the liquid through the outlet to the at least one nozzle; and discharging the liquid from the tank by removing only a portion of the liquid being transferred from the pump to the at least one nozzle.

* * * * *